US006061847A

United States Patent [19]

Jourdan

[11] Patent Number: 6,061,847

[45] Date of Patent: May 16, 2000

[54] LINKAGE ASSEMBLY FOR A POP-UP DRAIN STOPPER

[76] Inventor: Stanley A. Jourdan, 614 Egania St., New Orleans, La. 70117

[21] Appl. No.: 09/258,869

[22] Filed: Feb. 26, 1999

[51] Int. Cl.[7] ..... E03C 1/23

[52] U.S. Cl. ..... 4/689; 4/688; 4/684; 4/685; 4/690; 4/650; 4/653

[58] Field of Search ..... 4/650, 653, 682, 4/683, 684, 685, 686, 687, 689, 690, 691, 692, 693

[56] References Cited

U.S. PATENT DOCUMENTS

| | | | |
|---|---|---|---|
| 401,579 | 4/1889 | Newell | 4/687 |
| 3,353,192 | 11/1967 | Christiansen . | |
| 3,731,326 | 5/1973 | Politz . | |
| 4,192,026 | 3/1980 | Williams . | |
| 4,669,131 | 6/1987 | Barlow | 4/683 |
| 4,807,306 | 2/1989 | Hayman et al. . | |
| 4,903,943 | 2/1990 | Hochstrasser . | |
| 5,363,518 | 11/1994 | Mowery . | |

FOREIGN PATENT DOCUMENTS

| | | | |
|---|---|---|---|
| 1141572 | 9/1957 | France | 4/684 |

*Primary Examiner*—Steven O. Douglas
*Assistant Examiner*—Khoa D. Huynh
*Attorney, Agent, or Firm*—Kenneth L Tolar

[57] ABSTRACT

An improved linkage assembly for a pop-up drain stopper assembly includes an elongated connector bar having a plurality of apertures adjacent both its upper and lower ends. The assembly also includes a stem having a J-shaped portion of its lower end that is received within a select aperture. A lever arm is received within an aperture adjacent the lower end of the connector bar, the opposing end of which is attached to a drain stopper. The linkage assembly may be quickly and conveniently adjusted or dismantled with minimal effort.

3 Claims, 1 Drawing Sheet

LINKAGE ASSEMBLY FOR A POP-UP DRAIN STOPPER

BACKGROUND OF THE INVENTION

The present invention relates to a linkage assembly for a pop-up drain stopper that may be easily adjusted or dismantled.

DESCRIPTION OF THE PRIOR ART

Conventional pop-up drain stopper assemblies include a stem adjacent the faucet that moves the stopper up or down when the stem is vertically translated. The assemblies further include a pivoting lever arm with a first end that protrudes into the drain pipe to engage the drain stopper and a second end that is connected to the lower end of the stem by a vertically adjustable attachment means. The attachment means typically relates to a threaded portion on an end of the stem that is received within a threaded sleeve on the lever arm. However, a number of disadvantages are associated with such means. The threaded portion of the stem eventually unthreads from the sleeve and must be periodically re-tightened. Furthermore, the sleeve and threaded portion eventually become stripped and must be replaced. Finally, whenever the drain pipe is plugged, the stopper assembly must be dismantled. The assembly however, is cumbersome and laborious to disconnect and such activity further contributes to the stripping problem described above.

Various pop-up drain stopper assemblies exist in the prior art. For example, U.S. Pat. No. 4,903,943 issued to Hochstrasser discloses a linkage comprising a cylindrical socket at the outer end of the lever arm having a stem received therein. The stem is secured within the bore using a set screw.

U.S. Pat. No. 4,192,026 issued to Williams discloses a linkage comprising a vertical bar fastened to the lower end of the stem with a set screw and a lever arm received within one of a plurality of holes in the vertical bar. Also, the lever arm has a bifurcated spherical end and a collar inboard of the spherical end. The spherical end is compressed and passed through a selected hole on the lower end of the vertical bar until the collar abuts the bar to retain the lever arm in the hole.

Another type of vertically adjustable attachment means is illustrated in U.S. Pat. No. 3,731,326 issued to Politz and U.S. Pat. No. 3,353,192 issued to Christiansen. The attachment means apparently comprises a band attached to the stem at both ends to form a loop. The loop receives the outer end of the lever arm to connect the lever arm to the stem. The lever arm apparently features a similar band for receiving the stem to reinforce the connection. The bands, however, provide a tenuous, loose attachment means.

The present invention provides a linkage that eliminates the need for a set screw thereby overcoming the problems described above.

SUMMARY OF THE INVENTION

The present invention relates to a linkage assembly for a pop-up drain stopper that uses a specially designed stem and connector bar, allowing the assembly to be quickly and easily adjusted or dismantled. The assembly comprises an elongated stem having a J-shaped hook at its bottom end with a knob threadedly engaging its top end. The assembly also includes a connector bar with a plurality of vertically aligned apertures adjacent both its upper and lower ends. The J-shaped hook is removably received within one of the apertures adjacent the top end of the connector bar. A tubular lever arm is received within one of the apertures adjacent the lower end of the connector bar. The opposing end of the lever arm is received within the sink drain pipe and is attached to the drain stopper. At the upper end of the connector bar is a bracket member having a semi-circular groove for removably receiving the stem to prevent the stem from moving relative to the connector bar.

It is therefore an object of the present invention to provide an effective linkage assembly for a pop-up drain stopper that is durable.

It is another object of the present invention to provide a linkage assembly for a pop-up drain stopper that can be easily installed and adjusted to accommodate sinks with a wide variety of sizes and configurations.

It is yet another object of the present invention to provide a linkage assembly for a pop-up drain stopper that is inexpensive to manufacture.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
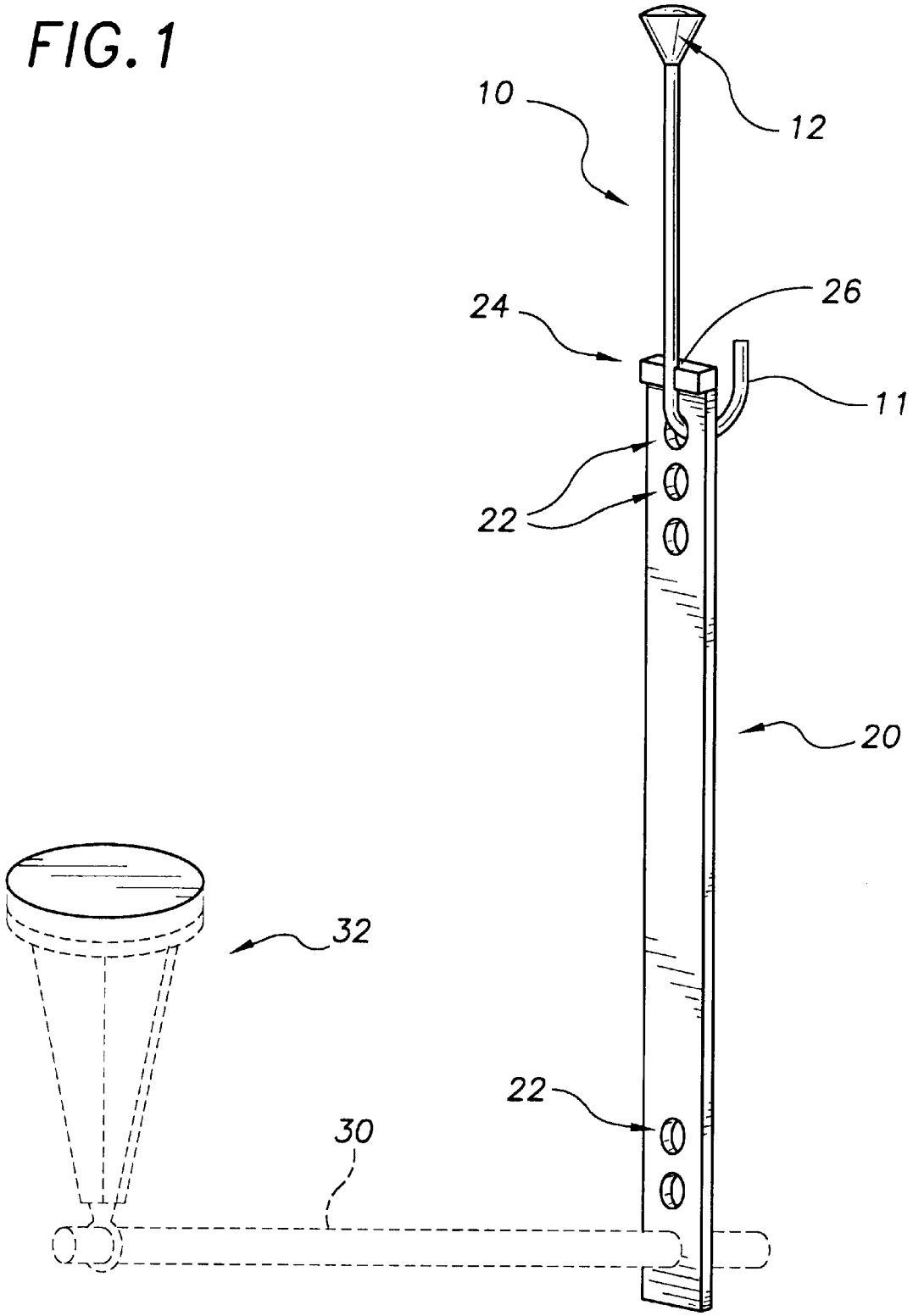
FIG. 1 depicts a perspective view of the linkage for a pop-up drain stopper assembly of the present invention.

Referring now to FIG. 1, the present invention comprises an improved linkage for a pop-up drain stopper including an elongated, substantially rigid actuating stem 10 having a top end and bottom end. The bottom end includes a J-shaped portion 11. A knob 12 theadedly engages the top end of the stem which may be grasped by a user when translating the stem.

The linkage further comprises an elongated, substantially rigid connector bar 20 with a plurality of vertically aligned apertures 22 adjacent its upper and lower ends. The J-shaped portion of the stem is removably received within one of the apertures adjacent the top end of the connector bar. The top end of the connector bar also includes a bracket member 24 having a substantially semi-cylindrical channel 26. The channel 26 is dimensioned to tightly and removably receive a portion of the stem in a snap like fashion to prevent the stem from moving relative to the connector bar.

The apertures 22 at the lower end of the connector bar 20 are dimensioned to tightly receive a first end of a lever arm 30. The opposing end of the lever arm is received within the sink drain pipe and is attached to a drain stopper 32. The lever arm 30 and the stem 10 may be inserted into a select aperture depending upon the relative distance required for a given sink construction.

The stem 10 and connector bar 20 can be made from metal or a substantially rigid, corrosion resistant material, such as plastic. The snap fitting 24 of the connector bar 20 is made from a material with sufficient resiliency to allow the shaft of the stem 10 to be snapped into the channel 26. Plastic or a similar material would suffice.

However, as will be readily apparent to those with ordinary skill in the art, the size, shape and materials of construction may easily be varied without substantially departing from the spirit of the present invention. From the foregoing description, it is now apparent that the present invention provides a linkage assembly for a pop up drain stopper that minimizes the problems associated with conventional linkages, especially those threaded connections. Although there has been shown and described the preferred embodiment of the present invention, it will be readily apparent to those skilled in the art that modifications may be made thereto which do not exceed the scope of the appended claims. Therefore, the scope of the invention is only to be limited by the following claims. The scope of the invention is therefore to be limited only by the following claims.

What is claimed is:

1. A pop-up drain stopper linkage assembly comprising:

an elongated connector bar having a top end and a bottom end with a plurality of apertures adjacent both the top and bottom ends;

an elongated actuating stem having an upper end and a lower end with a J-shaped portion at the lower end, said J-shaped portion received within a select aperture adjacent the top end of said connector bar;

a lever arm having a first end and a second end, the first end received within a select aperture adjacent the bottom end of said connector bar;

a drain stopper attached to the second end of said arm.

2. The linkage assembly of claim 1 further comprising:

a bracket member at the top end of said connector bar, said bracket member having a semi-cylindrical, vertically disposed channel thereon for removably and securely receiving said stem to prevent said stem from moving relative to said connector bar.

3. The linkage assembly of claim 1 further comprising a knob removably attached to the upper end of said stem which may be grasped by a user when moving said stem.

* * * * *